US009724549B2

(12) United States Patent
Buitenhuis

(10) Patent No.: US 9,724,549 B2
(45) Date of Patent: Aug. 8, 2017

(54) METHOD AND DEVICE FOR THE TESTING OF FIRE EXTINGUISHING SYSTEMS

(71) Applicant: Luphi B.V., Enschede (NL)

(72) Inventor: Antoon Lambertus Ruurd Buitenhuis, Enschede (NL)

(73) Assignee: Luphi B.V., Enschede (NL)

( * ) Notice: Subject to any disclaimer, the term of this patent is extended or adjusted under 35 U.S.C. 154(b) by 91 days.

(21) Appl. No.: 14/771,022

(22) PCT Filed: Feb. 26, 2014

(86) PCT No.: PCT/NL2014/050117

§ 371 (c)(1),
(2) Date: Aug. 27, 2015

(87) PCT Pub. No.: WO2014/133386

PCT Pub. Date: Sep. 4, 2014

(65) Prior Publication Data

US 2016/0001113 A1 Jan. 7, 2016

(30) Foreign Application Priority Data

Feb. 27, 2013 (NL) ..... 2010371

(51) Int. Cl.
*A62C 37/50* (2006.01)
*A62C 35/62* (2006.01)

(52) U.S. Cl.
CPC ..... *A62C 37/50* (2013.01); *A62C 35/62* (2013.01)

(58) Field of Classification Search
CPC ..... A62C 37/50; A62C 35/62
See application file for complete search history.

(56) References Cited

U.S. PATENT DOCUMENTS

| | | | | |
|---|---|---|---|---|
| 5,655,579 | A | 8/1997 | Prescott et al. | |
| 5,971,080 | A | 10/1999 | Loh et al. | |
| 6,865,341 | B1 | 3/2005 | Hurley | |
| 2003/0154763 | A1 * | 8/2003 | Cain | A62C 37/50 73/1.16 |
| 2010/0263882 | A1 * | 10/2010 | Bodemann | A62C 35/62 169/17 |

FOREIGN PATENT DOCUMENTS

| | | | | |
|---|---|---|---|---|
| DE | 4323508 | A1 | 1/1995 | |
| DE | WO 2012062484 | A1 * | 5/2012 | A62C 37/50 |
| JP | 2010234024 | A | 10/2010 | |
| NL | 2007339 | | 3/2013 | |

* cited by examiner

*Primary Examiner* — Nguyen Ha
(74) *Attorney, Agent, or Firm* — The Webb Law Firm

(57) ABSTRACT

An installation for testing open fire extinguishing systems includes a smoke and/or mist generator and a connecting conduit suitable and dedicated for being connected to a fire fighting system. A method for testing of fire extinguishing systems has the following steps performed in any suitable order: a) providing an installation for the generation of smoke and/or mist, b) connecting a conduit of the installation to a conduit of a first section of a preferably open fire extinguishing system, c) opening a valve which provides a connection between the first section of the fire fighting system and the connecting conduit of the installation, d) turning on the smoke and/or mist generator, such that, by the exiting of the smoke and/or mist, the spray heads of the first section of the fire extinguishing system can be inspected on their openness, e) repeating steps b-d for any further section of the fire extinguishing system.

14 Claims, 3 Drawing Sheets

METHOD AND DEVICE FOR THE TESTING OF FIRE EXTINGUISHING SYSTEMS

CROSS-REFERENCE TO RELATED APPLICATIONS

This application is the United States national phase of International Application No. PCT/NL2014/050117 filed Feb. 26, 2014, and claims priority to Netherlands Patent Application No. 2010371 filed Feb. 27, 2013, the disclosures of which are hereby incorporated in their entirety by reference.

BACKGROUND OF THE INVENTION

Field of the Invention

The invention relates to a method and installation for the testing of fire extinguishing systems. More in particular, the invention relates to a method and an installation for the testing of open fire extinguishing systems, so called deluge systems.

Description of the Related Art

These systems are amongst others used on gas and oil production locations and in the chemical industry. Typically an open fire extinguishing system comprises a number of spray heads, a storage tank for the extinguishing agent and/or a suction conduit to open sea, a pump and/or compressor, a network of conduits that connects the spray heads with the pump and a valve. As soon as a fire is being registered, the valve will be either by hand or automatically opened and water flows from a storage tank and/or from open sea through the network of conduits to substantially all the spray heads being connected to the network of conduits.

The functioning of such systems has to be tested on regular basis. For this, the installations to be protected need to be shut down, the valve need to be opened and the extinguishing agent, normally sea water, flows through the network of conduits and through the spray heads. The used extinguishing agent is being collected and transported to a regeneration installation. During this testing, the installations and systems to be protected often have to be shut down for security reasons.

A disadvantage of such tests is that a load of collected extinguishing agent arises, which need to be recycled and/or purified. Furthermore the shut down of the installations to be protected is expensive. In special in the case of offshore installations such tests are for these reasons expensive and complex. Furthermore during the testing of the extinguishing systems for offshore installations seawater is used. The salt in the seawater can cause unwanted corrosion in the extinguishing system and on the installations to be protected. The corroded conduits can get blocked by these corrosion particles or scaling. This can happen during the testing and during the intervals in between the testing. Often the spray head is the narrowest opening, in which scales of corroded particles can completely block the spray head. By using seawater, unwanted animals such as mussels, crabs, clamshells, stones, sand etc. can enter the network of conduits and reside therein, furthermore cultures of bacteria and/or other living organisms can reside in the network of conduits and block this. It is therefore possible that after a test several spray heads become clogged, while these spray heads were proven open during the testing as such. This can lead to unwanted dangerous situations in the installations.

The German patent application DE4323508 discloses a method for the testing of the closeness of spaces. This method does not test any open fire extinguishing installation, and does not give any discriminating result if an open fire extinguishing system functions well or not.

The American patent U.S. Pat. No. 5,655,579 discloses a method and a device for the testing of the capacity of an extinguishing system. In this method, exiting extinguishing agent is being collected in bags to be recycled. This system is not suited for testing open or deluge fire extinguishing systems.

The American patent U.S. Pat. No. 5,971,080 discloses a method of testing a quick response dry pipe sprinkler system. This system is a closed gas containing system, which is tested by a continuous flow of the gas within the system. Any pressure drop in the gas can indicate a leakage of the system. This system is configured with closed nozzles only. It is not an open deluge type of sprinkler system, and testing of the openness of the nozzles is not applicable. Therefore this system does not relate to, suggests or discloses any testing of open deluge systems.

Accordingly, the object of the invention is to provide a method and installation, that does not show or at least partially diminishes the herein above mentioned disadvantages, while the advantages thereof are at least partially remain. Furthermore, is an object of the invention to provide a method and installation, which is less expensive, less complex in use and less harmful for the installations and devices to be protected.

SUMMARY OF THE INVENTION

At least one of these and/or other objectives are reached with the installation, suitable for the testing of open, deluge fire extinguishing systems, wherein the installation comprises a smoke and/or mist generator and a connecting conduit, suitable and destined for the connecting of the smoke and/or mist generator to the fire extinguishing system, where in the generator comprises a compressor and/or a pump, that is able to generate a gas flow of at least 18 liters per second and/or a pressure drop of at least 0.2 bars and/or in which the exiting smoke has an optical smoke density of at least 10 $m^{-1}$. Alternatively, the exiting smoke can comprise a smoke density of 8 gram of nebulized smoke agent per cubic meter. The smoke agent can comprise a density of about 900-1100 kilogram per cubic meter and can comprise at least 30% mass PEG (poly ethylene glycol) and at least 30% alkane polyol. Herein the poly ethylene glycol can be a choice from one or more of the following components: di-, tri- tetra-, penta-, hexa-ethylene glycol. Furthermore, the polyethylene glycol can be a mixture of two or more of these components. Here in can the alkane polyol comprise a 1,2-propanediol, 1,3-propanediol, 1,2-butanediol 1,3-butanediol, 1,4-butanediol, 2,3-butanediol, 1,2 pentanediol, 1,3-pentanediol, 1,4-pentanediol, 1,5 pentanediol, 2,3-pentanediol, 2,4pentanediol. Furthermore, the smoking agent can comprise isopropyl alcohol, ethanol, acetone, methanol, 1 propanol, 1 butanol or water. Furthermore the alkane polyol can comprise a 3-valence and/or higher-valence alcohol.

The length of sight at a smoke density of the smoke of at least 8 grams per cubic meter air of a smoke agent with a specific weight of about 900-1100 kilogram per cubic meter can be less than 5 cm. A thicker smoke of for example 30 grams smoke agent per cubic meter can comprise a length of sight of less than 1 cm. The optical smoke density of the smoke can be higher than 10 per meter. The optical smoke density can furthermore be higher than 12 per meter or even higher than 20 per meter. Particularly useful smoke can comprise an optical smoke density higher than 25 per meter.

The optical smoke density is a measure for the extinction of a light source within the smoke over a specific path length. The used smoke needs to comprise a high optical smoke density. The higher the smoke density, the lower the length of sight and the thicker the smoke. By means of this, during an inspection, a properly functioning spray head is to be differentiated more clearly from a non-functioning spray head.

A further advantage of this installation is that, on the contrary to the testing with seawater, no solid parts can enter the extinguishing system.

By means of this installation, smoke and/or mist can be entered in the extinguishing system and it can be determined whether the spray heads of the system are all properly open, point at the right direction and if they are crooked or not. The exiting smoke is an indication of the properly functioning of the system and the spreading of the exiting smoke is an indication for the reach and the effectiveness of the fire extinguishing system.

A further advantage is that during the exiting of the smoke the spray heads in question can be disassembled, replaced and remounted, something that is impossible during a full water test.

The exiting speed of the smoke from the spray heads can be at least 10 meters per second. During the testing of a section of deluge fire extinguishing system with approximately 80 spray heads, a smoke production of about 200 liters per second can be needed.

Normally, open or deluge fire extinguishing systems are provided with more than one spray head and these spray heads have an exiting opening of a diameter of approximately 0.5-1.5 cm. In order to examine the direction of the exiting smoke sufficiently, a combination of sufficiently optical dense smoke and/or exiting smoke of sufficient flow rate can be needed. Smoke generators in the art do not provide the combination of flow rate and/or smoke density and are for these reasons less suitable for the testing of these specific systems. In order to determine the direction of the exiting smoke from a spray head, it can be advantageous, that the exiting smoke comprises a turbulence flow regime, which means that the Reynolds number of the exiting smoke at the exiting of the spray head is higher than about 10000.

The smoke and/or mist generator can substantially comprise a pressure drop of at least 0.2 bars. At such flow rates, the pressure drop over the network of conduits of deluge firefighting systems can play a role of importance. Furthermore in parts of conduits, water can have remained. By having a smoke and/or mist generator that can generate these pressure drops, the eventually remaining water within the network of conduits can be forced out and the pressure drop over the network of conduits can be compensated. Thus eventually in so-called pockets remaining water can be removed. The removal of the remaining water can further reduce corrosion.

This smoke and/or mist generator can comprise a heating element. By means of this the mist or smoke can be generated. These heating elements can comprise an electrical glowing spiral or burner. The power of this element can set the amount of smoke and/or mist to be generated.

The smoke and/or mist generator can comprise a storage container. Therein a smoke agent such as a liquid or a solid can be stored which can be guided to the heating element by means of a pump or a transporting device.

The mist generator can comprise a ventilator or a compressor, by means of which the exiting mist and/or smoke can bridge a pressure drop and can be forced through the network of conduits. This ventilator or compressor can be positioned in an air inlet conduit to a heating chamber, in which the smoke and/or mist is being generated, or can be positioned in a smoke and/or mist exiting conduit.

The connecting conduit of the smoke and/or mist generator can comprise a connecting element, which fits on a connecting device of the extinguishing system. By means of this element a substantially closed connection between the smoke and/or mist generator and the network of conduits of the fire extinguishing system can be obtained.

The Installation, as described herein above, can form part of an open or deluge fire extinguishing system or can be permanently installed thereon, therein or in fluid connection therewith. Thus for the testing, the system generating the smoke needs only to be switched on and to be connected with consecutively or simultaneously to the individual sections of the extinguishing system by opening and/or closing the appropriate valves of the system. Thus a separate connecting and installation of the smoke generating unit can be omitted. This way, even more time could be saved in testing the openness of the individual spray heads and of the conduits of the deluge or open fire extinguishing system.

The invention further comprises a method for the testing of open deluge fire extinguishing systems, which method comprises the following steps, to be executed in any suitable order to be exercised steps: a) The providing of a smoke and/or mist generator as described herein above, b) The connecting of a connecting conduit on a first section of the extinguishing system, c) The opening of a valve, which enables a connection between the network of conduits of a first section of the extinguishing system and the connection conduit of the installation, d) The turning on of the smoke and/or mist generator, such that the connecting network of the first section fills up with smoke and/or mist and by the exiting of the smoke and/or mist from the spray heads of the air first section of the extinguishing system can be inspected, and e) The eventual repeating of the steps b through d for any further section of the fire extinguishing system.

By means of this method, smoke and/or mist can be entered into the fire extinguishing system and it can be examined whether the spray heads of the system all are open, all point at the right direction and whether they are crooked or not. The exiting smoke is an indication that the system functions well and the direction of the exiting smoke and the spreading of the exiting smoke is an indication for the area of reach and the effectiveness of the fire extinguishing system.

The fire extinguishing system can be an open fire extinguishing system (open deluge system).

The spray area of the individual spray heads can be inspected, by examining the cone or cloud of smoke and/or mist exiting the spray heads.

Thus, the quality of the fire extinguishing system can be inspected well while the installations to be protected do not have to be shut down. In direct relation with the herein above mentioned methods, the invention relates to a method for the production and/or recovery of oil and/or gas where in the method comprises the following steps to be performed in any suitable order: providing an installation for the production of oil and/or gas, the installation of an open, deluge sprinkler system on at least a part on the installation for the production or recovery of oil and/or gas, the providing on determined intervals or permanently of a smoke and/or mist generator as described herein above, and the testing of the open, deluge sprinkler system on dedicated times according to a method according to a method of testing as described herein above.

By producing or recovering of oil and/or gas in an installation provided with such a sprinkler system and by testing this system according to the here in above described method, a safer production and recovery of oil and/or gas is possible.

BRIEF DESCRIPTION OF THE DRAWINGS

The invention will be further elucidated by means of embodiments which are depicted in the figures, in the figures.

DETAILED DESCRIPTION OF THE INVENTION

Figure 1:
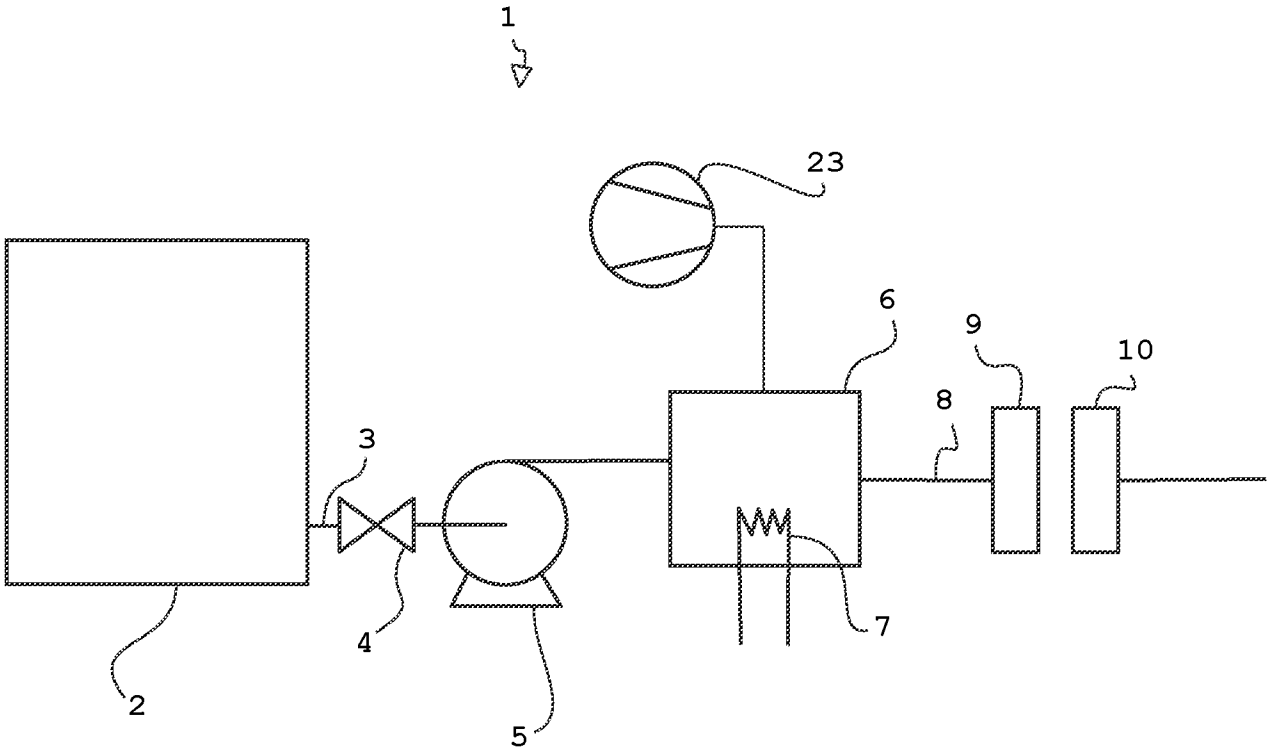
FIG. 1 depicts a schematic representation of a smoke and/or mist generator according to a first embodiment of the invention.

It is noted that the figures are only a schematic representation of preferred embodiments of the invention. The figures should not be considered limited for the invention in any way or form. In the figures, the same or similar parts are referred to by the same or similar reference numerals.

The expression "connected with", "being in connection with" and/or words of such meaning, that is used in this specification and/or the conclusions, should be understood as, is however not limited to the existence of a substantially fluid tight connection between the parts in question.

The expression "gas flow rate" that is used in this specification and/or the conclusions should be considered as, is however not limited to a volume flow, normally expressed in cubic meters per second, where in the exiting volume flow is meant.

The expression "pressure drop" that is used in this specification and/or the conclusions, should considered as, is however not limited to a measurement for the amount of pressure that a pump or compressor can meet.

The expression "smoke density" that is used in this specification and/or the conclusions, should be considered as, is however not limited to a measurement for the amount of extinction of a light source by amount of smoke over a certain path length.

The expression "length of sight" is the maximum distance over which a normal human eye can distinctly examine a non-lit object.

The expression "smoke" that is used in this specification and/or other claims is to be considered as, is however not limited to a fine distribution of drops or particles in a gas. In the application normally nebula or mist is used. The expression "smoke" is to be explicitly understood as nebula and mists as well. In that case a liquid is evaporated in a gas flow, which cools down and condensates to a fine mist or nebula.

In FIG. 1, a schematic depiction of a smoke and/or mist generator 1 is shown. The smoke and/or mist generator comprises a storage container 2, which is connected through a conduit 3 and a valve 4 to a pump 5. The pump is connected with a heating chamber 6, wherein heating element 7 transfers the liquid smoking agent into a smoke and/or mist. Consequently the smoke and/or mist is guided to a connecting element 9 by means of a smoke conduit 8. The connecting element 9 fits substantially free of leaks on a connecting element 10 of the fire extinguishing system. In order to generate sufficiently mist and/or smoke or to provide smoke and/or mist with a sufficient pressure, a ventilator or compressor 23 can be connected to the heating chamber 6. This ventilator or compressor 23 can alternatively also be mounted within the smoke and/or mist conduit 8.

Figure 2:
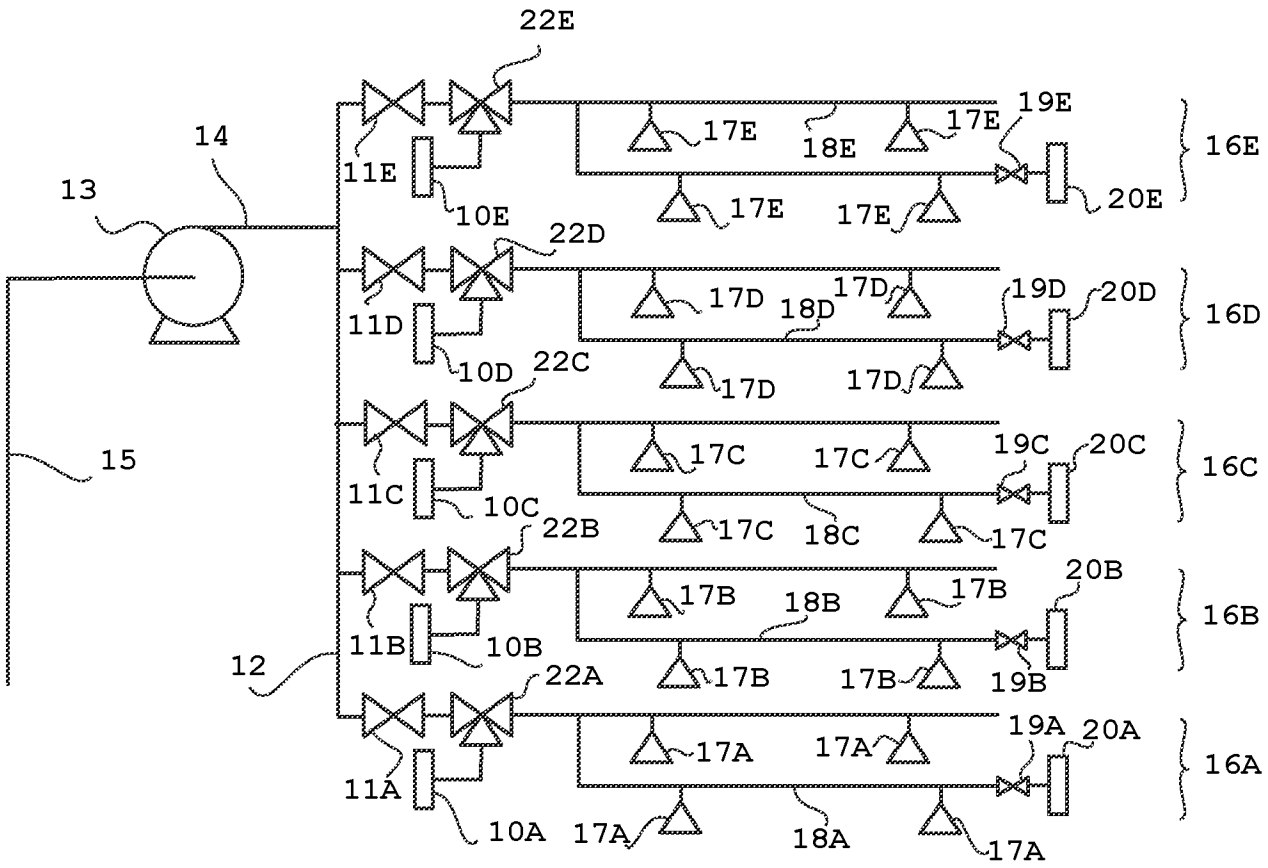
FIG. 2 depicts a schematic representation of a fire fighting system for the application of the invention.

FIG. 2 discloses a first embodiment of a fire extinguishing system. This system comprises a number of five extinguishing sections 16A-16E each with its own network of conduits. The sections 16A-16E are connected with the pump 13 through a header 12 and a conduit 14. Each section 16A-16E can be provided with a three-way valve 22A-22E, which can be each connected to the connecting element 9 of the smoke and/or mist generator through the connecting conduit 10A-10E. On each network of conduits of these sections 16A-16E spray heads 17A-17E are connected. In an open fire extinguishing system, also known as deluge system, the spray heads 17A-17E are in open connection with the network of conduits and is the system, when idle, substantially empty. In contrast to sprinkler systems where all spray heads are closed and opened only by heat, in an open fire extinguishing system all spray heads are open.

If the fire extinguishing system for a certain section 16A-16E is being opened by automatically operation or operation by hand of one or more of the valves 11A-11E, the pump 13 will start to operate and fills the network of conduits of the section with extinguishing agent and all the spray heads 17*a*-17*e* of the section in question 16*a*-16*e* starts to spray.

Figure 3:
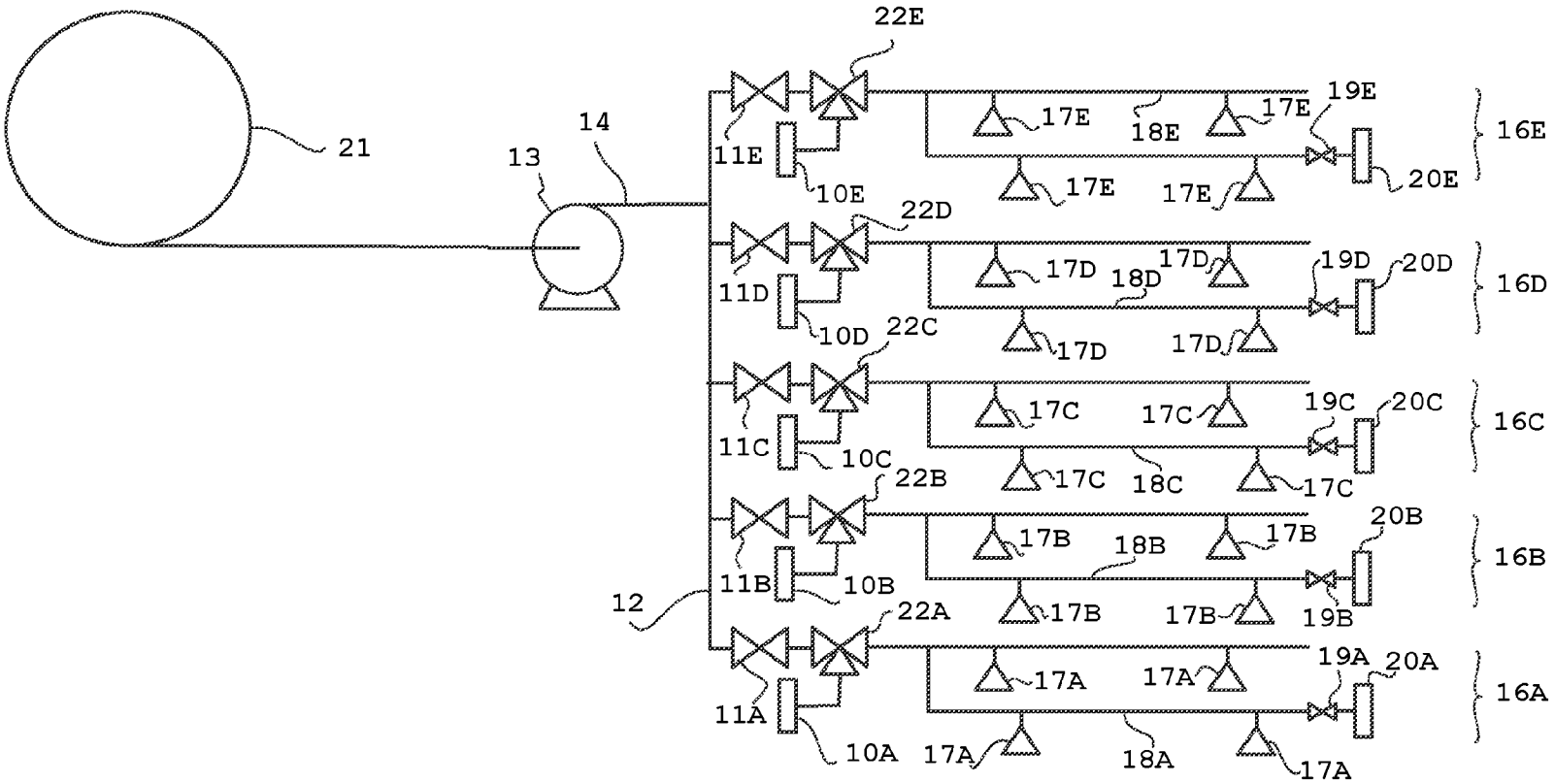
FIG. 3 represents a schematic depiction of an alternative firefighting system for the application of the invention.

In the system as being shown in FIG. 2, the extinguishing agent is seawater that is obtained through suction conduit 15 directly from the open sea. In the system as is shown in FIG. 3, the extinguishing agent is stored in a storage container 21. The extinguishing agent can in this case be water but can also be any other suitable agent. By closing valve 11A from section 16A, opening the 3-way valve 22A to the connecting conduit 10A and to the connection element 9 of the smoke and/or mist generator, and hereafter turning the smoke and/or mist generator on, the network of conduits of the section 16A can fill up with smoke and/or mist. During the fill up of the network of conduits with mist or smoke, the spray heads 17A, which are in open connection with the network of conduits of the section 16A, will start to exhaust smoke and/or mist. Thus, it can be inspected whether each of the spray heads 17*a* is open. If smoke and/or mist is entered in the network of conduits with sufficient flow rate, each individual spray head can be tested on the reach of the spray as well. Thus crooked, blocked and/or wrongly installed spray heads can be identified and instantly be replaced and/or repaired.

Furthermore, it can be inspected whether the fire extinguishing system sufficiently reaches all the installations and spaces to be protected without any shut down of the installations to be inspected. In open fire extinguishing systems, the openness of the system is predominantly tested and the openness of the individual spray heads is tested. Typical deluge systems comprise per section between 5 and 100 open nozzles. Each nozzle comprises an opening of substantially between 0.5-1.5 cm diameter and eventually a deflector being positioned in front of the opening. The deflector can be positioned in front of the opening and can transfer the exiting water from the nozzle of the spray head to a cone shaped spray. Typical deflectors are plates, cones, spirals and curved plates, eventually or not provided with holes. In order to properly test such a system, sufficiently smoke needs to be entered into the system to detect an exiting amount of smoke at all nozzles.

It is noted that the invention is not restricted to the embodiments as discussed herein above. It is for example possible to use a sort of foam instead of smoke and/or mist during the testing. The smoke and/or mist can comprise a specific colouring agent, such that the distinction between from the installation exiting of smoke and/or mist and the smoke and/or mist existing from the fire extinguishing system during testing can be distinguished.

Alternatively to the application of the 3-way nozzle 22A-22E, the smoke and/or mist generator can also be connected to a drain connection 20A-20E, to a connector for a pressure gauge, to a nozzle or to a spray head. This can be of advantage in case the three-way valves 22A-22E and/or the connection conduits 10A-10E are absent within the system to be tested.

Though in FIGS. 2 and 3 three-way valves 22A-22E are being applied, alternatively also a T-connector with a valve can be used. As a security measurement, a signal in relation to the position of the valves 11*a*-11*e* can be guided to a central operating system.

Such and other alternatives will be clear for the skilled man and are considered to be within the frame of the invention as claimed in the appended claims.

LIST OF REFERENCE NUMERALS

1. Smoke and/or mist generator
2. Storage container
3. Conduit
4. Valve
5. Pump
6. Heating chamber
7. Heating element
8. Smoke and/or mist conduit
9. Connecting element
10. Connecting conduit
11A-E. Valves
12. Header
13. Pump
14. Pressure conduit
15. Suction conduit
16A-E. Sections
17A-E. Spray heads
18A-E. Network of conduits
19A-E. Drain valves
20A-E. Drain connecting valves
21. Storage container
22A-E. 3-way valves
23. Ventilator or compressor.

The invention claimed is:

1. An installation, suitable for testing a deluge fire extinguishing system, comprising:

a smoke and/or mist generator and a connecting conduit, suitable and dedicated for connecting the smoke and/or mist generator to the deluge fire extinguishing system;

wherein the smoke and/or mist generator comprises a compressor and/or a pump which is able to generate a gas flow of at least 18 liters per second and/or is able to generate a pressure drop of at least 0.2 bars and/or which is able to generate a smoke to be generated with an optical smoke density of at least 10 per meter.

2. The installation according to claim 1, wherein the installation comprises a gas flow to be generated of at least 50 liters per second.

3. The installation according to claim 1, wherein the installation comprises a smoke to be generated with an optical smoke density of at least 20 per meter.

4. The installation according to claim 1, wherein the installation comprises a smoke to be generated with an optical smoke density of at least 100 per meter.

5. The installation according to claim 1, wherein the smoke and/or mist generator comprises a heating element.

6. The installation according to claim 1, wherein the smoke and/or mist generator comprises a storage container.

7. The installation according to claim 1, wherein the connecting conduit comprises a connecting element, which fits on a connecting element of the deluge fire extinguishing system.

8. The installation according to claim 1, wherein the installation forms part of the deluge fire extinguishing system or is permanently installed thereon, therein or in fluid connection therewith.

9. A method for testing a deluge fire extinguishing system, comprising the following steps to be performed in any suitable order:

a) providing an installation for generating smoke and/or mist;

b) connecting a conduit of the installation to a first section of the deluge fire extinguishing system;

c) opening a valve, to connect the deluge fire extinguishing system to the connecting conduit of the installation;

d) turning on a smoke and/or mist generator, such that a network of conduits of a first section of the deluge fire extinguishing system fills up with smoke and/or mist; inspecting spray heads of the first section of the deluge fire extinguishing system to determine a measure of exiting smoke and/or mist;

e) repeating steps b-d for any further section of the deluge fire extinguishing system.

10. The method according to claim 9, wherein a mass flow of the smoke and/or mist is chosen such that an exiting speed of the smoke and/or mist from the spray heads is at least 10 meters per second and/or wherein an optical smoke density of the smoke and/or mist is at least 1 per meter and/or wherein the installation can generate a pressure drop of at least 0.2 bars.

11. The method according to claim 9, wherein a reach of spray of the individual spray heads is being inspected, by registering a cone and/or cloud of smoke and/or mist exiting from the spray head.

12. A method of passing smoke and/or mist through a network of conduits of a deluge fire extinguishing system for testing openness of the deluge fire extinguishing system, wherein the smoke and/or mist comprises an optical smoke density of at least 1 per meter and/or wherein a flow of the smoke and/or mist being inserted in the deluge fire extinguishing system is chosen such that a speed of the smoke and/or mist exiting from spray heads of the deluge fire extinguishing system is at least 10 meters per second.

13. The method of claim 9, wherein the deluge fire extinguishing system is associated with an installation for production and/or reclaiming of oil and/or gas.

14. The installation of claim 1, in combination with a fire extinguishing system associated with an installation for production and/or reclaiming of oil and/or gas.

* * * * *